US007365702B2

(12) United States Patent
Liu

(10) Patent No.: US 7,365,702 B2
(45) Date of Patent: Apr. 29, 2008

(54) ANTENNA DEVICE

(75) Inventor: I-Ru Liu, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 75 days.

(21) Appl. No.: 11/352,997

(22) Filed: Feb. 14, 2006

(65) Prior Publication Data

US 2007/0188395 A1 Aug. 16, 2007

(51) Int. Cl.

| | |
|---|---|
| ***H01Q 15/14*** | (2006.01) |
| ***H01Q 21/12*** | (2006.01) |
| ***H01Q 21/00*** | (2006.01) |
| ***H01Q 19/10*** | (2006.01) |
| ***H01Q 19/30*** | (2006.01) |

(52) U.S. Cl. ..... 343/912; 343/815; 343/817; 343/818; 343/819; 343/834; 343/835

(58) Field of Classification Search ..... 343/912, 343/815, 817, 818, 819, 834, 835
See application file for complete search history.

(56) References Cited

U.S. PATENT DOCUMENTS 6,774,859 B2 * 8/2004 Schantz et al. ..... 343/742

* cited by examiner

*Primary Examiner*—Hoang V Nguyen
*Assistant Examiner*—Robert Karacsony
(74) *Attorney, Agent, or Firm*—Birch, Stewart, Kolasch & Birch, LLP

(57) ABSTRACT

An antenna device includes a first elliptic reflective surface, a first antenna and a second antenna. The first elliptic reflective surface has a first focus and a second focus. The first antenna is disposed on the first focus, and the second antenna is disposed on the second focus. The first antenna transmits a first signal and a second signal, and the second antenna receives the first signal and the second signal. The first signal is transmitted directly to the second antenna from the first antenna. The second signal is reflected by the first elliptic reflective surface and transmitted to the second antenna.

21 Claims, 5 Drawing Sheets

3 –

ANTENNA DEVICE

BACKGROUND OF THE INVENTION

1. Field of Invention

The invention relates to an antenna device and, in particular, to an antenna device with an elliptic reflective surface.

2. Related Art

The rapid development in radio transmission has brought us many products and technologies for multiple-band transmissions. Many new products are equipped with wireless transmission functions to satisfy consumer's needs.

The radio transmission technology usually uses an antenna to transmit or receive electromagnetic (EM) waves for signal transmissions or receptions. However, when the antenna is transmitting or receiving the EM waves and there is another antenna transmitting or receiving the EM waves in its vicinity, then the two antennas will interfere with each other. For example, a wireless access point (AP) has two antennas for signal reception and emission, respectively. When an antenna is transmitting signals, the other antenna for receiving signals may receive the signal transmitted by the wireless AP itself. Therefore, the wireless AP needs some mechanism to avoid such interference. Therefore, it is always a research problem to avoid the interference between antennas and to achieve higher efficiency.

An early solution is to dispose antennas at a long distance apart. However, a longer distance inevitably increases the length of the cable and the cost. An alternative solution is to eliminate EM interference by absorption or shielding. However, this kind of methods requires additional hardware and thus also increases the cost. In addition, another method is to use an analog circuit or a digital processor to process the signals by delaying them in order to achieve the goal of canceling the signals. However, its drawback is its complicated electronic circuit and technique.

It is therefore an important subject of the invention to provide a simpler mechanism at a lower cost to prevent the EM interference between antennas so that they have higher efficiency.

SUMMARY OF THE INVENTION

In view of the foregoing, the invention is to provide an antenna device with a simpler mechanism at a lower cost to prevent the EM interference between antennas so that they have higher efficiency.

To achieve the above, an antenna device in accordance with the invention includes a first elliptic reflective surface, a first antenna, and a second antenna The first elliptic reflective surface has a first focus and a second focus. The first antenna is disposed on the first focus, and the second antenna is disposed on the second focus. The first antenna delivers a first signal and a second signal, and the second antenna receives the first signal and the second signal. The first signal is transmitted directly to the second antenna from the first antenna. The second signal is reflected by the first elliptic reflective surface and transmitted to the second antenna.

In addition, an antenna device in accordance with the invention includes several elliptic reflective surfaces, several transmitting antennas, and several receiving antennas. Each of the elliptic reflective surfaces has two foci, one of which coincides with one focus of its adjacent elliptic reflective surface. The transmitting antennas are disposed on some of the foci to transmit a first signal and a second signal. The receiving antennas are disposed on the rest foci to receive at least one first signal and at least one second signal. The first signal is transmitted directly to the receiving antennas from the transmitting antennas. The second signal is reflected by the elliptic reflective surfaces and transmitted to the receiving antennas.

As mentioned above, the antennas of the antenna device of the invention are disposed on the foci of the elliptic reflective surfaces. Since each elliptic reflective surface has two foci and the signal transmitted from one of its foci will be reflected by the elliptic reflective surface and transmitted to the other focus. Therefore, the antenna disposed on the focus receives the signal from the other antenna via two different paths. One signal is directly transmitted from one antenna to the other without reflection, and the other signal is reflected by the elliptic reflective surface. If the two signals simultaneously reach the receiving antenna, they will cancel with each other, thereby solving the interference problem. Thus, the antenna can have better efficiency.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
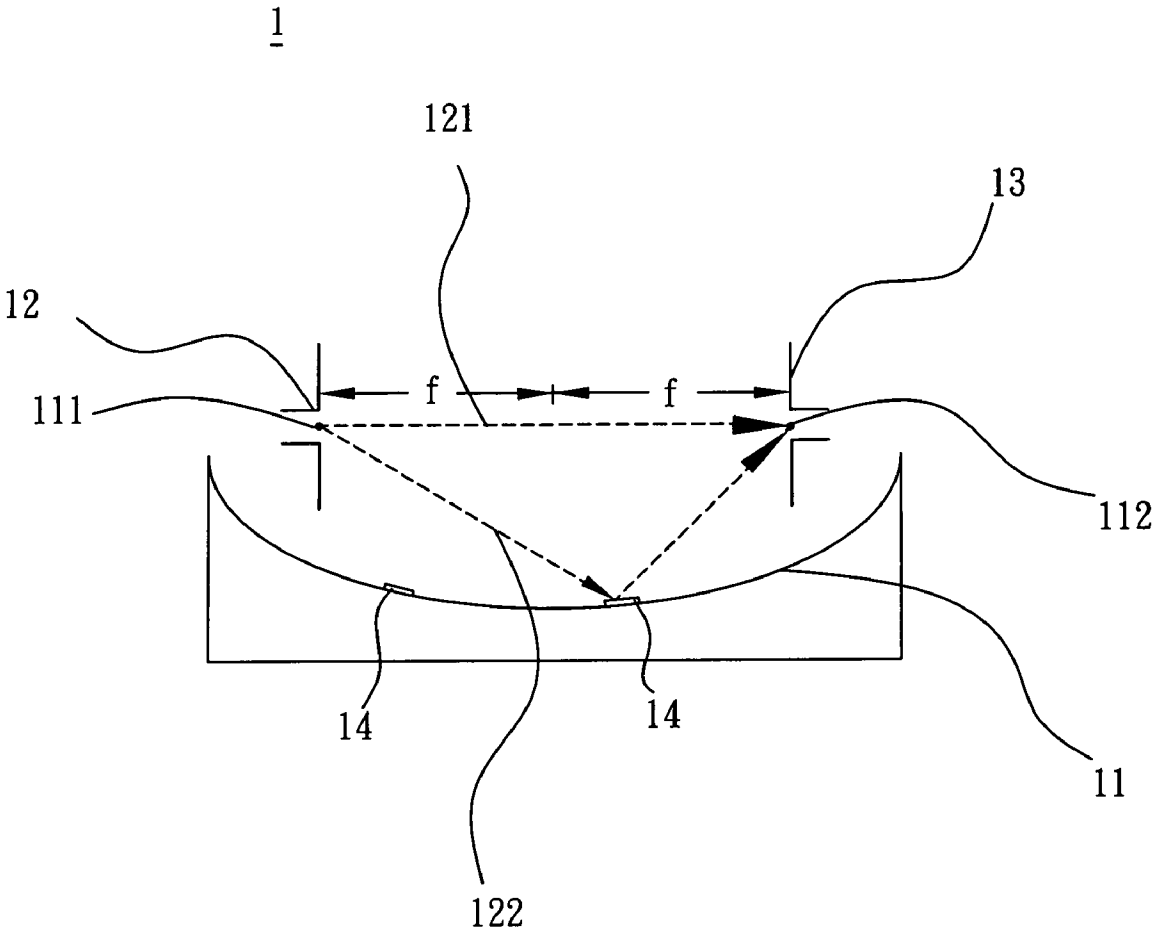
FIG. 1 is a schematic view of an antenna device according to a first embodiment of the invention.

With reference to FIG. 1, an antenna device 1 according to the first embodiment of the invention includes a first elliptic reflective surface 11, a first antenna 12, and a second antenna 13. In this embodiment, the first elliptic reflective surface 11 can be a part of an elliptic cylinder or an ellipsoid. The first antenna 12 and the second antenna 13 can be vertically polarized antennas or dipole antennas.

The first elliptic reflective surface 11 has a first focus 111 and a second focus 112. The first antenna 12 and the second antenna 13 are disposed respectively on the first focus 111 and the second focus 112. The first antenna 12 transmits a first signal 121 and a second signal 122. The first signal 121 is transmitted directly from the first antenna 12 to the second antenna 13. The second signal 122 is reflected by the first elliptic reflective surface 11 and transmitted to the second antenna 13. The phase difference between the first signal 121 and the second signal 122 received by the second antenna 13 is $\pi$.

A latus rectum of the first elliptic reflective surface 11 is greater than half the wavelength of the first signal 121 and the second signal 122 transmitted by the first antenna 12. Besides, at least one reflective pad 14 is disposed on the first elliptic reflective surface 11 so as to adjust the amplitude of the second signal 122 received by the second antenna 13.

Therefore, the first signal 121 and the second signal 122 received by the second antenna 13 can cancel with each other more completely.

In the following, the computation method of the parameters needed for the first elliptic reflective surface 11 will be described. Suppose f is half the distance between the first antenna 12 and the second antenna 13, λ is the wavelength of the first signal 121 and the second signal 122 transmitted by the first antenna 12, a is half the major axis of the first elliptic reflective surface 11, b is half the minor axis of the first elliptic reflective surface 11, e is the eccentricity of the first elliptic reflective surface 11, and r is the length of the latus rectum of the first elliptic reflective surface 11. I have:

$$a = f + \frac{\lambda}{4};$$

$$e = \frac{f}{a};$$

$$b = a(1 - e^2)^{\frac{1}{2}}; \text{ and}$$

$$r = \frac{2b^2}{a} > \frac{\lambda}{2}.$$

Figure 2:
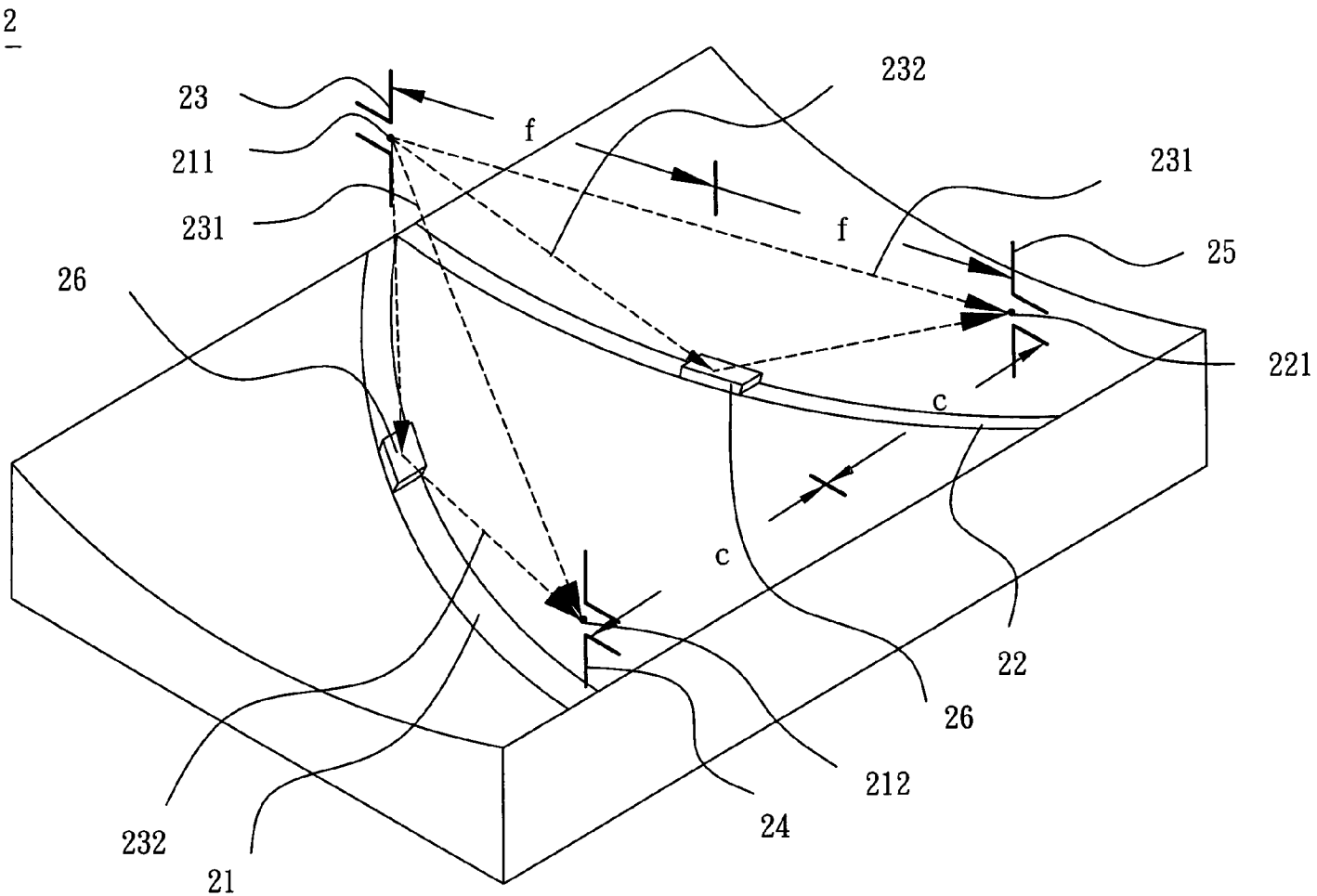
FIG. 2 is a schematic view of an antenna device according to a second embodiment of the invention.

With reference to FIG. 2, an antenna device 2 according to a second embodiment of the invention includes a first elliptic reflective surface 21, a second elliptic reflective surface 22, a first antenna 23, a second antenna 24, and a third antenna 25. In this embodiment, the first antenna 23, the second antenna 24, and the third antenna 25 can be vertically polarized antennas or dipole antennas.

In this embodiment, the first elliptic reflective surface 21 has a first focus 211 and a second elliptic reflective surface 212. The second elliptic reflective surface 22 has a third focus 221 and another focus coinciding with the first focus 211 of the first elliptic reflective surface 21. The first antenna 23, the second antenna 24, and the third antenna 25 are disposed on the first focus 211, the second focus 212, and the third focus 221, respectively. The first antenna 23 transmits a first signal 231 and a second signal 232. The first signal 231 is directly transmitted to the second antenna 24 and the third antenna 25. The second signal 232 is reflected by the first elliptic reflective surface 21 and transmitted to the second antenna 24 and by the second elliptic reflective surface 22 to the third antenna 25. The phase differences between the first signal 231 and the second signal 232 received by the second antenna 24 and the third antenna 25 are bothπ. The latus rectums of the first elliptic reflective surface 21 and the second elliptic reflective surface 22 are larger than half the wavelength of the first signal 231 and the second signal 232 transmitted by the first antenna 23. As in the first embodiment, the first elliptic reflective surface 21 and the second elliptic reflective surface 22 may be disposed with at least one reflective pad 26, so that the first signal 231 and the second signal 232 received by the second antenna 24 and the third antenna 25 can cancel with each other more completely.

In the following, the computation method of the parameters needed for the first elliptic reflective surface 21 and the second elliptic reflective surface 22 will be described. The first antenna 23, the second antenna 24, and the third antenna 25 are disposed at the vertices of an isosceles triangle. Half the major axis a, half the minor axis b, the eccentricity e and the length of the latus rectum r of the second elliptic reflective surface 22 are the same as those of the first elliptic reflective surface 21. The segment between the second antenna 24 and the third antenna 25 is the base side of the isosceles triangle. In this case, c is half the length of the base side, f is half the distance between the first antenna 23 and the second antenna 24 (and the third antenna 25), and λ is the wavelength of the first signal 231 and the second signal 232 transmitted by the first antenna 23. I have:

$$c = \lambda;$$

$$a = f + \frac{\lambda}{4};$$

$$e = \frac{f}{a};$$

$$b = a(1 - e^2)^{\frac{1}{2}}; \text{ and}$$

$$r = \frac{2b^2}{a} > \frac{\lambda}{2}.$$

Figure 3:
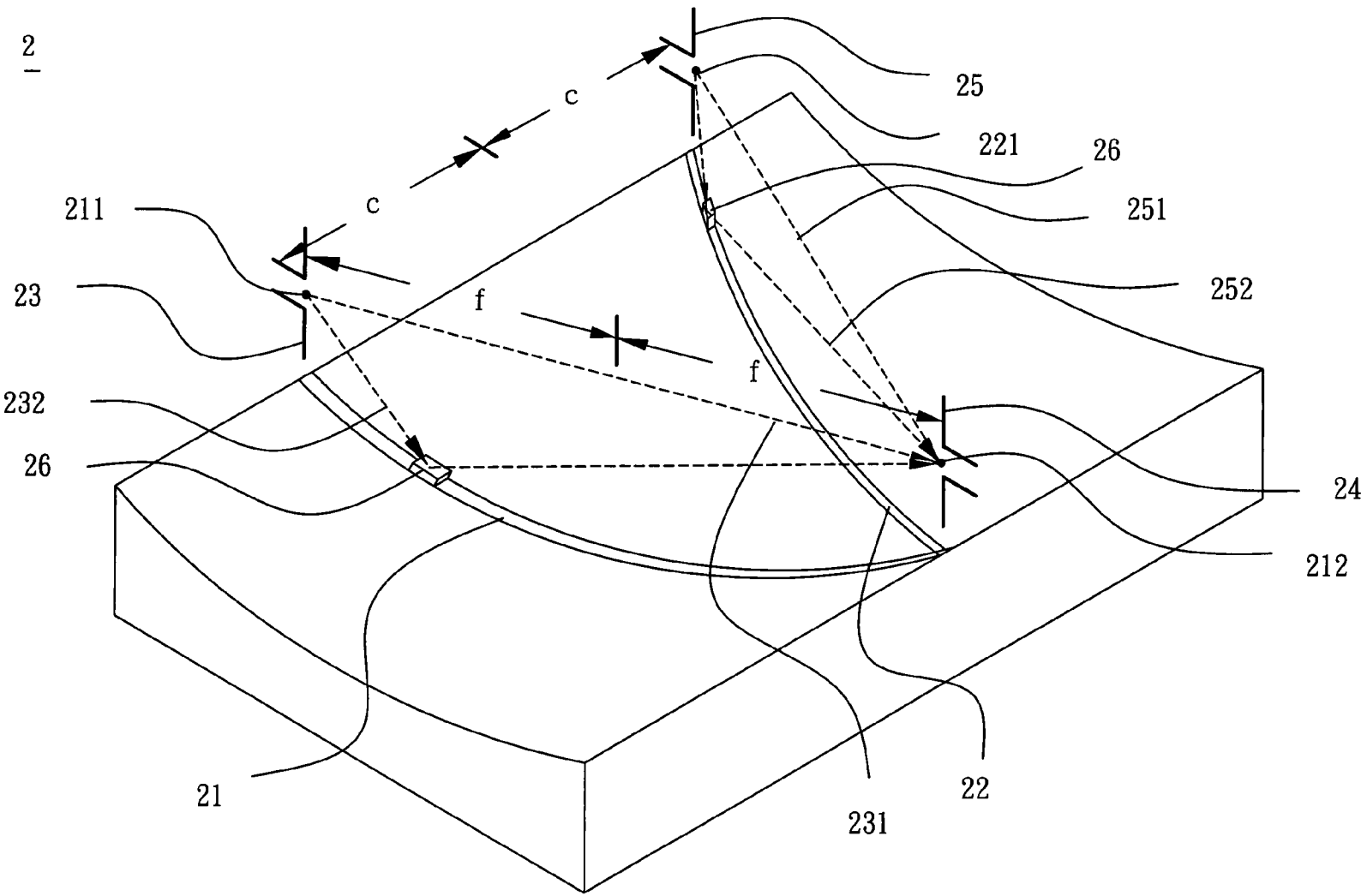
FIG. 3 is another schematic view of the antenna device according to a second embodiment of the invention.

FIG. 3 shows another example of the second embodiment. All the devices in this example have the same structure and features as those in the above-mentioned second embodiment, so the detailed descriptions are omitted. Herein, the difference is in that the other focus of the second elliptic reflective surface 22 coincides with the second focus 212 of the first elliptic reflective surface 21, and the third antenna 25 transmits a third signal 251 and a fourth signal 252. The third signal 251 is transmitted directly from the third antenna 25 to the second antenna 24. The fourth signal 252 is reflected by the second elliptic reflective surface 22 and transmitted to the second antenna 24. The phase difference between the third signal 251 and the fourth signal 252 received by the second antenna 24 is π. Besides, one latus rectum of the second elliptic reflective surface 22 is greater than half the wavelength of the third signal 251 and the fourth signal 252 transmitted by the third antenna 25. As in the second embodiment, the second elliptic reflective surface 22 can be disposed with at least one reflective pad 26, so that the third signal 251 and the fourth signal 252 received by the second antenna 24 can cancel with each other more completely.

Figure 4:
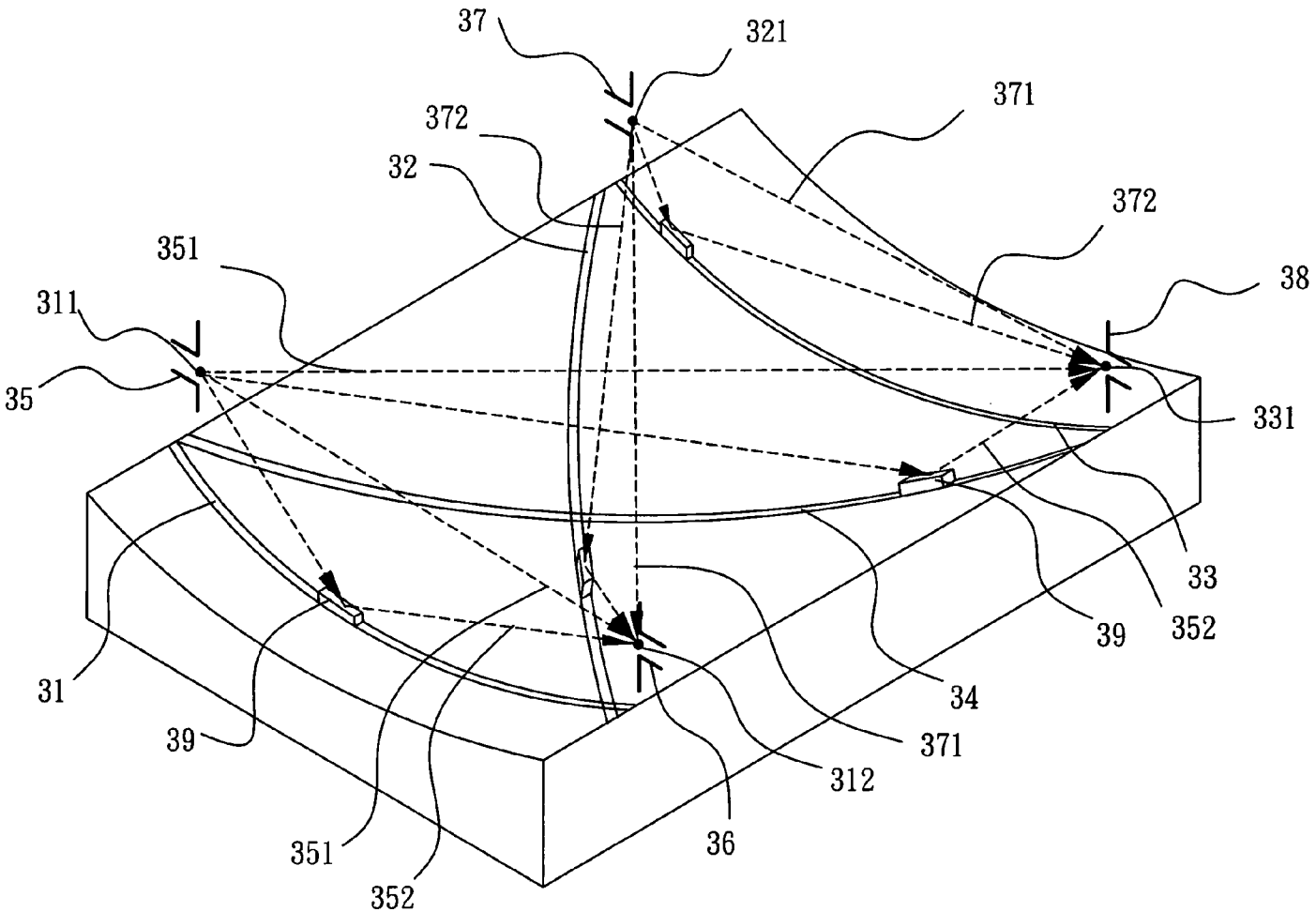
FIG. 4 is a schematic view of an antenna device according to a third embodiment of the invention.

With reference to FIG. 4, an antenna device 3 according to a third embodiment of the invention includes a first elliptic reflective surface 31, a second elliptic reflective surface 32, a third elliptic reflective surface 33, and a fourth elliptic reflective surface 34. The first elliptic reflective surface 31 has a first focus 311 and a second focus 312. The second elliptic reflective surface 32 has a third focus 321 and another focus coinciding with the second focus 312 of the first elliptic reflective surface 31. The third elliptic reflective surface 33 has a fourth focus 331 and another focus coinciding with the third focus 321 of the second elliptic reflective surface 32. One focus of the fourth elliptic reflective surface 34 coincides with the first focus 311, and the other focus coincides with the fourth focus 331. The first antenna 35, the second antenna 36, the third antenna 37, and the fourth antenna 38 are disposed respectively on the first focus 311, the second focus 312, the third focus 321, and the fourth focus 331. In this embodiment, the first antenna 35, the second antenna 36, the third antenna 37, and the fourth antenna 38 can be dipole antennas or vertically polarized antennas.

The first antenna 35 transmits a first signal 351 and a second signal 352. The third antenna 37 transmits a third signal 371 and a fourth signal 372. The first signal 351 is directly transmitted from the first antenna 35 to the second antenna 36 and the fourth antenna 38. The second signal 352 is reflected by the first elliptic reflective surface 31 and transmitted to the second antenna 36 and by the fourth elliptic reflective surface 34 to the fourth antenna 38. The phase difference between the first signal 351 and the second signal 352 received by the second antenna 36 and the fourth antenna 38 is π. The third signal 371 is directly transmitted from the third antenna 37 to the second antenna 36 and the fourth antenna 38. The fourth signal 372 is reflected by the second elliptic reflective surface 32 and transmitted to the second antenna 36 and by the third elliptic reflective surface 33 to the fourth antenna 38. The phase difference between the third signal 371 and the fourth signal 372 received by the second antenna 36 and the fourth antenna 38 is π. Besides, one latus rectum of the first elliptic reflective surface 31 and the fourth elliptic reflective surface 34 is greater than half the wavelength of the first signal 351 and the second signal 352 transmitted by the first antenna 35. One latus rectum of the second elliptic reflective surface 32 and the third elliptic reflective surface 33 is greater than half the wavelength of the third signal 371 and the fourth signal 372 received by the third antenna 37. As in the previous embodiment, each of the elliptic reflective surfaces can be disposed with at least one reflective pad 39, so that the first signal 351 and the second signal 352 as well as the third signal 371 and the fourth signal 372 received by the second antenna 36 and the fourth antenna 38 can cancel with each other more completely.

Figure 5:
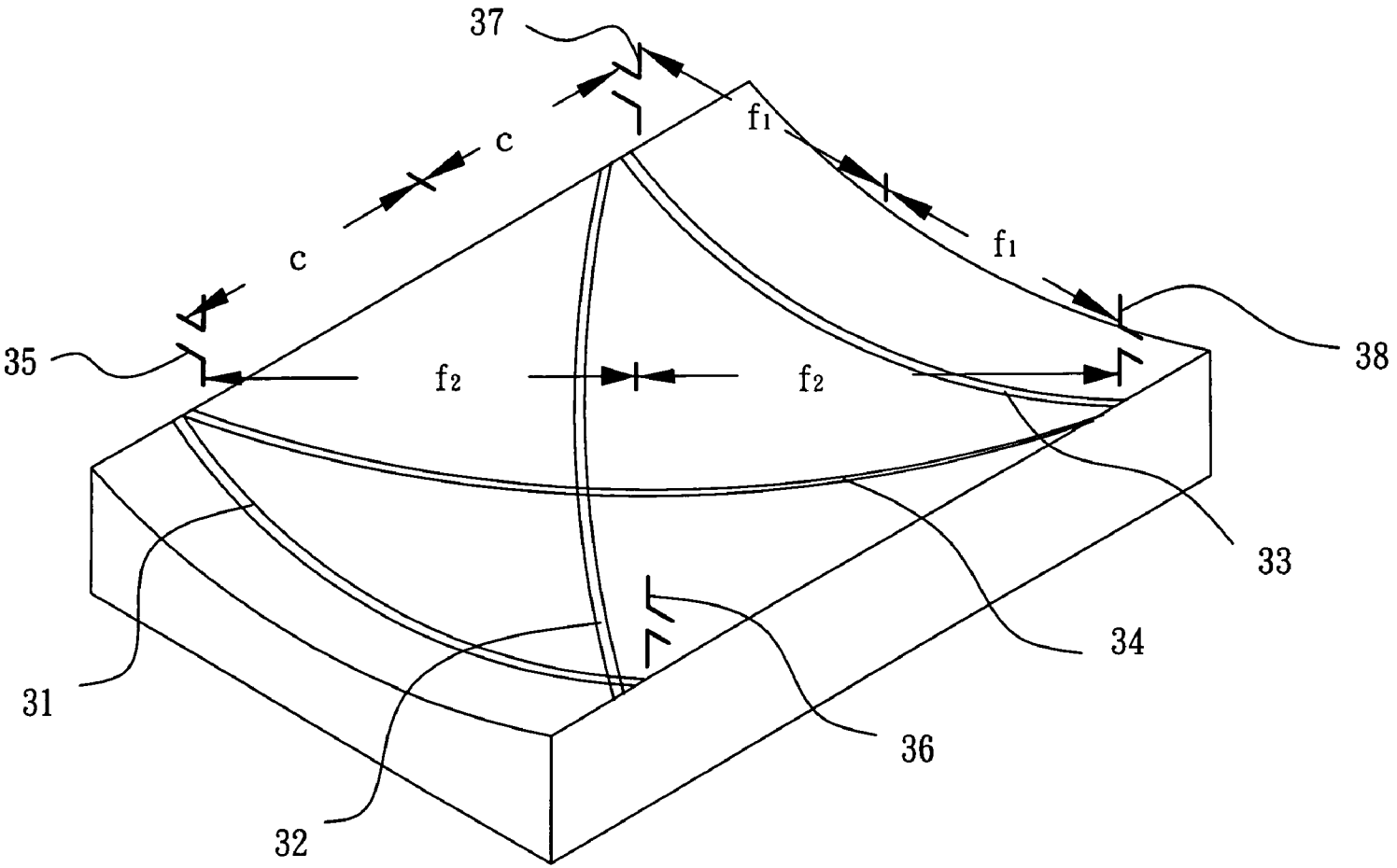
FIG. 5 is another schematic view of the antenna device according to a third embodiment of the invention.

With reference to FIG. 5, the parameters of the elliptic reflective surfaces in the third embodiment are explained as follows. The first antenna 35, the second antenna 36, the third antenna 37, and the fourth antenna 38 are disposed in such a way to form a rectangle. In this case, $f_1$ is half the distance between the first antenna 35 and the second antenna 36, c is half the distance between the second antenna 36 and the fourth antenna 38, $f_2$ is half the distance between the first antenna 35 and the fourth antenna 38, $a_1$ is half the major axis of the first elliptic reflective surface 31, $b_1$ is half the minor axis of the first elliptic reflective surface 31, $e_1$ is the eccentricity of the first elliptic reflective surface 31, $r_1$ is the length of the latus rectum of the first elliptic reflective surface 31, $a_2$ is half the major axis of the second elliptic reflective surface 32, $b_2$ is half the minor axis of the second elliptic reflective surface 32, $e_2$ is the eccentricity of the second elliptic reflective surface 32, and $r_2$ is the length of the latus rectum of the second elliptic reflective surface 32. The wavelength of the first signal 351, the second signal 352, the third signal 371, and the fourth signal 372 transmitted by the first antenna 35 and the third antenna 37 is λ. Half the major axis $a_1$, half the minor axis $b_1$, the eccentricity $e_1$, and the length of the latus rectum $r_1$ of the third elliptic reflective surface 33 are the same as those of the first elliptic reflective surface 31. Half the major axis $a_2$, half the minor axis $b_2$, the eccentricity $e_2$, and the length of the latus rectum $r_2$ of the fourth elliptic reflective surface 34 are the same as those of the second elliptic reflective surface 32. I then have:

$$a_1 = f_1 + \frac{3\lambda}{4};$$

$$e_1 = \frac{f_1}{a_1};$$

$$b_1 = a_1(1 - e_1^2)^{\frac{1}{2}};$$

$$b_2 = b_1;$$

-continued $$r_1 = \frac{2b_1^2}{a_1} > \frac{\lambda}{2};$$

$$c = (8f_1^2 + 6\lambda \times f_1 + \lambda^2)^{\frac{1}{2}};$$

$$f_2 = (f_1^2 + c^2)^{\frac{1}{2}};$$

$$a_2 = f_2 + \frac{\lambda}{4};$$

$$e_2 = \frac{f_2}{a_2}; \text{ and}$$

$$r_2 = \frac{2b_2^2}{a^2} > \frac{\lambda}{2}.$$

To be noted, in the second and third embodiments, the signals can be processed by using the space diversity, beam forming, or spatial multiplexing technique according to needs.

In summary, in accordance with the disclosed antenna device, the antennas are disposed on the foci of the elliptic reflective surfaces. Since each elliptic reflective surface has two foci and the signal transmitted from one of its foci will be reflected by the elliptic reflective surface and transmitted to the other focus. Therefore, the antenna disposed on the focus receives the signal from the other antenna via two different paths. One signal is directly transmitted from one antenna to the other without reflection, and the other signal is reflected by the elliptic reflective surface. If the two signals simultaneously reach the receiving antenna, they will cancel with each other, thereby solving the interference problem. Thus, the antenna can have better efficiency.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An antenna device, comprising:

a first elliptic reflective surface having a first focus and a second focus;

a first antenna disposed on the first focus for transmitting a first signal and a second signal; and a second antenna disposed on the second focus for receiving the first signal and the second signal, wherein the first signal is directly transmitted from the first antenna to the second antenna, and the second signal is reflected by the first elliptic reflective surface and transmitted to the second antenna.

2. The antenna device of claim 1, wherein the phase difference between the first signal and the second signal received by the second antenna is π.

3. The antenna device of claim 1, wherein a latus rectum of the first elliptic reflective surface is greater than half the wavelength of the first signal and the second signal transmitted by the first antenna.

4. The antenna device of claim 1, wherein the first elliptic reflective surface is disposed with at least one reflective pad having a reflective surface above said elliptical reflective surface.

5. The antenna device of claim 1, wherein the first elliptic reflective surface is a part of an ellipsoid or an elliptic cylinder.

6. The antenna device of claim 1, wherein the first antenna and/or the second antenna is a dipole antenna or a vertically polarized antenna.

7. The antenna device of claim 1, further comprising:

a second elliptic reflective surface having a third focus and another focus coinciding with the first focus; and a third antenna disposed on the third focus for receiving the first signal and the second signal, wherein the first signal is directly transmitted from the first antenna to the third antenna, and the second signal is reflected by the second elliptic reflective surface and transmitted to the third antenna.

8. The antenna device of claim 7, wherein the phase difference between the first signal and the second signal received by the third antenna is $\pi$.

9. The antenna device of claim 7, wherein a latus rectum of the second elliptic reflective surface is greater than half the wavelength of the first signal and the second signal transmitted by the first antenna.

10. The antenna device of claim 7, wherein the second elliptic reflective surface is disposed with at least one reflective pad having a reflective surface above said elliptical reflective surface.

11. The antenna device of claim 7, wherein the third antenna is a dipole antenna or a vertically polarized antenna.

12. The antenna device of claim 1, further comprising:

a second elliptic reflective surface having a third focus and another focus coinciding with the second focus; and a third antenna disposed on the third focus for transmitting a third signal and a fourth signal, wherein the third signal is directly transmitted from the third antenna to the second antenna, and the fourth signal is reflected by the second elliptic reflective surface and transmitted to the second antenna.

13. The antenna device of claim 12, wherein the phase difference between the third signal and the fourth signal received by the second antenna is $\pi$.

14. The antenna device of claim 12, wherein a latus rectum of the second elliptic reflective surface is greater than half the wavelength of the third signal and the fourth signal transmitted by the third antenna.

15. The antenna device of claim 12, wherein the second elliptic reflective surface is disposed with at least one reflective pad having a reflective surface above said elliptical reflective surface.

16. The antenna device of claim 12, wherein the third antenna is a dipole antenna or a vertically polarized antenna.

17. An antenna device, comprising:

a plurality of elliptic reflective surfaces, wherein each of the elliptic reflective surfaces has two foci and one of the foci coincides with one focus of one adjacent elliptic reflective surface;

a plurality of transmitting antennas disposed on one part of the foci for respectively transmitting a first signal and a second signal; and a plurality of receiving antennas disposed on the other part of the foci for respectively receiving at least one of the first signals and at least one of the second signals, wherein the first signal is directly transmitted from the transmitting antenna to the receiving antenna, and the second signal is reflected by the elliptic reflective surface to the receiving antenna.

18. The antenna device of claim 17, wherein the phase difference between the first signal and the second signal received by the receiving antenna is $\pi$.

19. The antenna device of claim 17, wherein a latus rectum of each of the elliptic reflective surfaces is greater than half the wavelength of the first signal and the second signal transmitted by the transmitting antenna.

20. The antenna device of claim 17, wherein at least one of the elliptic reflective surfaces is disposed with at least one reflective pad having a reflective surface above said elliptical reflective surface.

21. The antenna device of claim 17, wherein each of the transmitting antennas and/or the receiving antennas is a dipole antenna or a vertically polarized antenna.

* * * * *